US005881383A

United States Patent [19]

Perkins

[11] Patent Number: 5,881,383

[45] Date of Patent: Mar. 16, 1999

[54] POCKETED NECKTIE

[76] Inventor: Betty J. Perkins, 152 E. 109th Pl., Los Angeles, Calif. 90061

[21] Appl. No.: 90,139

[22] Filed: Jun. 4, 1997

[51] Int. Cl.[6] ..... F41D 25/00

[52] U.S. Cl. ..... 2/144; 2/145; 2/247; 383/4

[58] Field of Search ..... 2/144, 145, 152.1, 2/155–157, 1, 247, 249; 383/4

[56] References Cited

U.S. PATENT DOCUMENTS

| | | | |
|---|---|---|---|
| D. 264,892 | 6/1982 | Stewart, Jr. et al. | 2/144 X |
| 517,769 | 4/1894 | Selowsky | 2/144 |
| 3,206,765 | 9/1965 | Sherman | 2/144 |
| 3,842,436 | 10/1974 | Hirschson | 2/157 |
| 5,073,987 | 12/1991 | Crosier | 2/144 |

*Primary Examiner*—Gloria M. Hale

[57] ABSTRACT

A pocketed necktie for holding items therein. The pocketed necktie includes front and back tie panels. The outer perimeters of the front and back tie panels are coupled together. A neck strap is also provided and has first and second ends. The first end of the neck strap is coupled to the back tie panel. The second end of the neck strap is detachably attached to the back tie panel. The pocketed necktie also has front and back pocket panels. The outer perimeters of the front and back pocket panels are coupled together to define a pocket space between the front and back pocket panels. The back pocket panel is coupled to the back tie panel. The back pocket panel has an elongate slit therethrough providing an opening into the pocket space.

12 Claims, 2 Drawing Sheets

POCKETED NECKTIE

BACKGROUND OF THE INVENTION

1. Field of the Invention

The present invention relates to neck apparel and more particularly pertains to a new pocketed necktie for holding items therein.

2. Description of the Prior Art

The use of neck apparel is known in the prior art. More specifically, neck apparel heretofore devised and utilized are known to consist basically of familiar, expected and obvious structural configurations, notwithstanding the myriad of designs encompassed by the crowded prior art which have been developed for the fulfillment of countless objectives and requirements.

Known prior art neck apparel include U.S. Pat. No. 4,710,982; U.S. Pat. No. 3,206,765; U.S. Pat. No. 3,744,058; U.S. Pat. No. 3,842,436; U.S. Pat. No. Des. 378,007; and U.S. Pat. No. 5,435,011.

While these devices fulfill their respective, particular objectives and requirements, the aforementioned patents do not disclose a new pocketed necktie. The inventive device includes front and back tie panels. The outer perimeters of the front and back tie panels are coupled together. A neck strap is also provided and has first and second ends. The first end of the neck strap is coupled to the back tie panel. The second end of the neck strap is detachably attached to the back tie panel. The pocketed necktie also has front and back pocket panels. The outer perimeters of the front and back pocket panels are coupled together to define a pocket space between the front and back pocket panels. The back pocket panel is coupled to the back tie panel. The back pocket panel has an elongate slit therethrough providing an opening into the pocket space.

In these respects, the pocketed necktie according to the present invention substantially departs from the conventional concepts and designs of the prior art, and in so doing provides an apparatus primarily developed for the purpose of holding items therein.

SUMMARY OF THE INVENTION

In view of the foregoing disadvantages inherent in the known types of neck apparel now present in the prior art, the present invention provides a new pocketed necktie construction wherein the same can be utilized for holding items therein.

The general purpose of the present invention, which will be described subsequently in greater detail, is to provide a new pocketed necktie apparatus and method which has many of the advantages of the neck apparel mentioned heretofore and many novel features that result in a new pocketed necktie which is not anticipated, rendered obvious, suggested, or even implied by any of the prior art neck apparel, either alone or in any combination thereof.

To attain this, the present invention generally comprises front and back tie panels. The outer perimeters of the front and back tie panels are coupled together. A neck strap is also provided and has first and second ends. The first end of the neck strap is coupled to the back tie panel. The second end of the neck strap is detachably attached to the back tie panel. The pocketed necktie also has front and back pocket panels. The outer perimeters of the front and back pocket panels are coupled together to define a pocket space between the front and back pocket panels. The back pocket panel is coupled to the back tie panel. The back pocket panel has an elongate slit therethrough providing an opening into the pocket space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pocketed necktie apparatus and method which has many of the advantages of the neck apparel mentioned heretofore and many novel features that result in a new pocketed necktie which is not anticipated, rendered obvious, suggested, or even implied by any of the prior art neck apparel, either alone or in any combination thereof.

It is another object of the present invention to provide a new pocketed necktie which may be easily and efficiently manufactured and marketed.

It is a further object of the present invention to provide a new pocketed necktie which is of a durable and reliable construction.

An even further object of the present invention is to provide a new pocketed necktie which is susceptible of a low cost of manufacture with regard to both materials and labor, and which accordingly is then susceptible of low prices of sale to the consuming public, thereby making such pocketed necktie economically available to the buying public.

Still yet another object of the present invention is to provide a new pocketed necktie which provides in the apparatuses and methods of the prior art some of the advantages thereof, while simultaneously overcoming some of the disadvantages normally associated therewith.

Still another object of the present invention is to provide a new pocketed necktie for holding items therein.

Yet another object of the present invention is to provide a new pocketed necktie which includes front and back tie panels. The outer perimeters of the front and back tie panels are coupled together. A neck strap is also provided and has first and second ends. The first end of the neck strap is coupled to the back tie panel. The second end of the neck strap is detachably attached to the back tie panel. The pocketed necktie also has front and back pocket panels. The outer perimeters of the front and back pocket panels are coupled together to define a pocket space between the front and back pocket panels. The back pocket panel is coupled to the back tie panel. The back pocket panel has an elongate slit therethrough providing an opening into the pocket space.

Still yet another object of the present invention is to provide a new pocketed necktie that provides a private pocket for safely holding valuable items therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
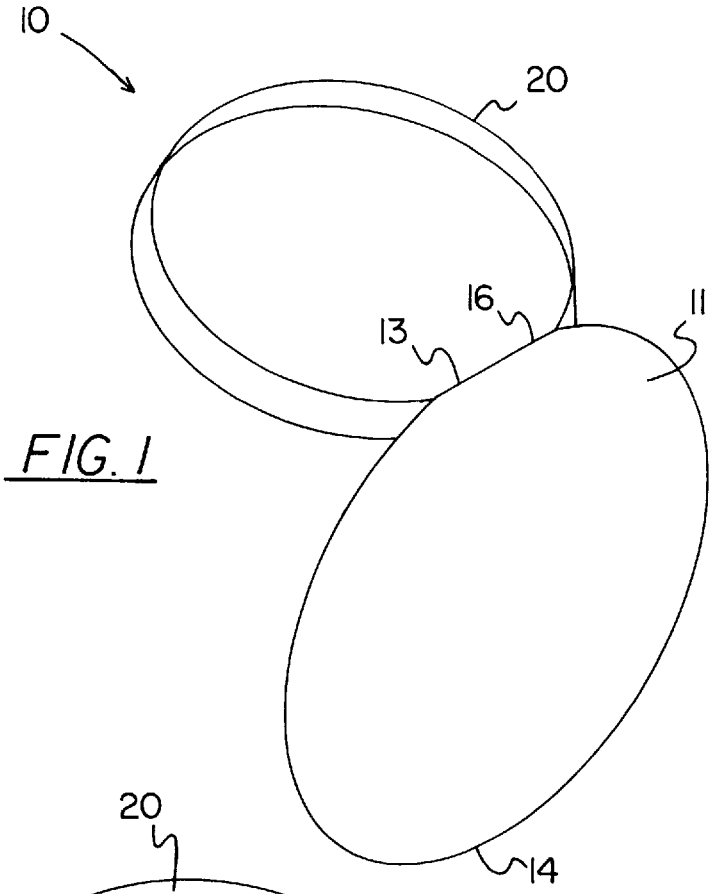
FIG. 1 is a schematic perspective view of a new pocketed necktie according to the present invention.

With reference now to the drawings, and in particular to FIGS. 1 through 4 thereof, a new pocketed necktie embodying the principles and concepts of the present invention and generally designated by the reference numeral 10 will be described.

As best illustrated in FIGS. 1 through 4, the pocketed necktie 10 generally comprises front and back tie panels 11,12. The outer perimeters of the front and back tie panels 11,12 are coupled together. A neck strap 20 is also provided and has first and second ends 21,22. The first end 21 of the neck strap 20 is coupled to the back tie panel 12. The second end 22 of the neck strap 20 is detachably attached to the back tie panel 12. The pocketed necktie 10 also has front and back pocket panels 30,31. The outer perimeters of the front and back pocket panels 30,31 are coupled together to define a pocket space 36 between the front and back pocket panels 30,31. The back pocket panel 31 is coupled to the back tie panel. The back pocket panel 31 has an elongate slit 35 therethrough providing an opening into the pocket space 36.

Figure 3:
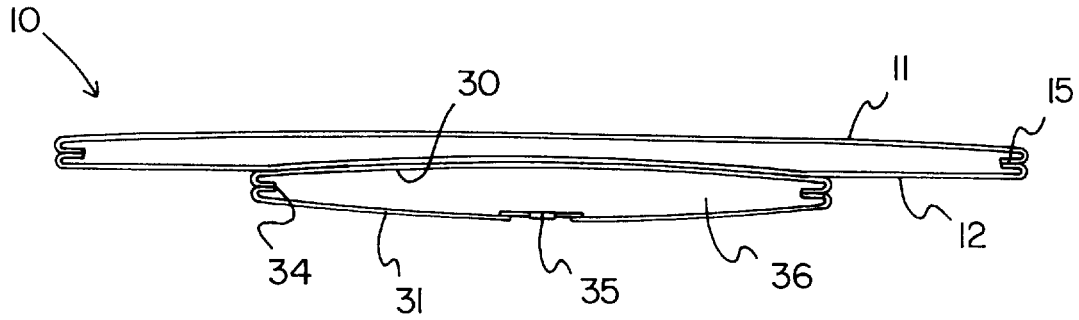
FIG. 3 is a schematic cross sectional view of the present invention taken from line 3—3 of FIG. 2.

In closer detail, the front and back tie panels 11,12 each have an outer perimeter and a top 13 and a bottom 14. The front and back tie panels 11,12 are positioned adjacent one another. The tops 13 of the front and back tie panels 11,12 are positioned adjacent one another and the bottoms 14 of the front and back tie panels 11,12 are positioned adjacent one another. Preferably, the front and back tie panels 11,12 comprises a fabric material. The front and back tie panels 11,12 are coupled together completely around their outer perimeters. Ideally, as illustrated in FIG. 3, each of the outer perimeters of the front and back tie panels 11,12 have inwardly extending tucked portions 15 stitched together to attach the outer perimeters of the front and back tie panels 11,12 together. The front and back tie panels 11,12 each have an axis extending between the top and bottom 13,14.

Figure 2:
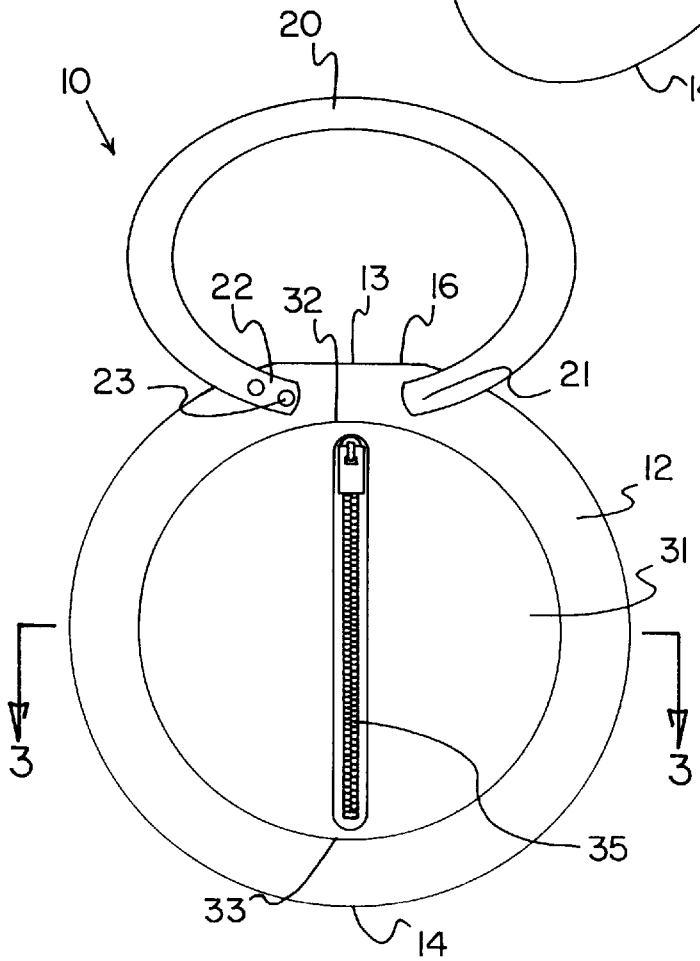
FIG. 2 is a schematic back side view of the present invention.

With reference to FIGS. 1 and 2 in a preferred embodiment, the outer perimeters of the front and back tie panels 11,12 are generally circular and each have a diameter. Preferably, the diameters of the outer perimeters of the front and back pocket panels 30,31 are both greater than about 3 inches. Ideally, the diameters of the outer perimeters of the front and back tie panels 11,12 are about 4 inches. Preferably, the outer perimeter of each of the front and back tie panels 11,12 each have a generally straight edge portion 16 located at the top 13 of the respective tie panel. The straight edge portions 16 have a length extending substantially perpendicular to the axes of the front and back tie panels 11,12 with the lengths of the straight edge portions 16 less than the diameter of the respective tie panel.

The neck strap 20 is generally arcuate and has first and second ends 21,22. Preferably, the neck strap 20 comprises a flexible material. The neck strap 20 is designed for wrapping around the neck of a wearer. The first end 21 of the neck strap 20 is coupled to the top of the back tie panel and is preferably positioned adjacent one end of the straight edge portion 16 of the outer perimeter of the back tie panel. The second end 22 of the neck strap 20 is detachably attached to the top of the back tie panel and is preferably positioned adjacent another end of the straight edge portion 16 of the outer perimeter of the back tie portion. Ideally, a pair of snap fasteners 23 detachably attach the second end 22 of the neck strap 20 to the top 13 of the back tie panel 12.

The pocketed necktie 10 also includes front and back pocket panels 30,31 each having an outer perimeter and a top 32 and a bottom 33. Preferably, the front and back pocket panels 30,31 each comprise a flexible fabric material. The front and back pocket panels 30,31 are positioned adjacent one another. The tops 32 of the front and back pocket panels 30,31 are positioned adjacent one another and the bottoms 33 of the front and back pocket panels 30,31 are positioned adjacent one another. Ideally, the front and back pocket panels 30,31 comprises a fabric material. As illustrated in FIG. 3, the front and back pocket panels 30,31 are coupled together completely around their outer perimeters. Preferably, each of the outer perimeters of the front and back pocket panels 30,31 have inwardly extending tucked portions that are stitched together to attach the outer perimeters of the front and back pocket panels 30,31 together. The front and back pocket panels 30,31 define a pocket space 36 therebetween for holding items therein. The front and back pocket panels 30,31 each have an axis extending between the top and bottom 32,33 of the respective pocket panel. With reference to FIGS. 1 and 2, in the preferred embodiment, the outer perimeters of the front and back tie panels 11,12 are generally circular and have a diameter. Ideally, the diameters of the outer perimeters of the front and back pocket panels 30,31 are less than the diameters of the outer perimeters of the front and back tie panels 11,12. The back pocket panel 31 is coupled to the back tie panel 21. The tops of the pocket panels are positioned towards the top of the back tie panel and the bottom of the pocket panels are positioned towards the bottom of the back tie panel. Preferably, the axes of the pocket panels lie along the axis of the back tie panel 21. The front and back pocket panels

30,31 are preferably generally centered on the back tie panel such that the outer perimeters of the pocket panels are generally equally spaced apart from the outer perimeters of the tie panels.

The back pocket panel 31 has an elongate slit 35 therethrough providing an opening into the pocket space 36. The slit 35 has a length that is extended along the axis of the back pocket panel 31. Ideally, a zipper substantially closes the slit 35.

Figure 4:
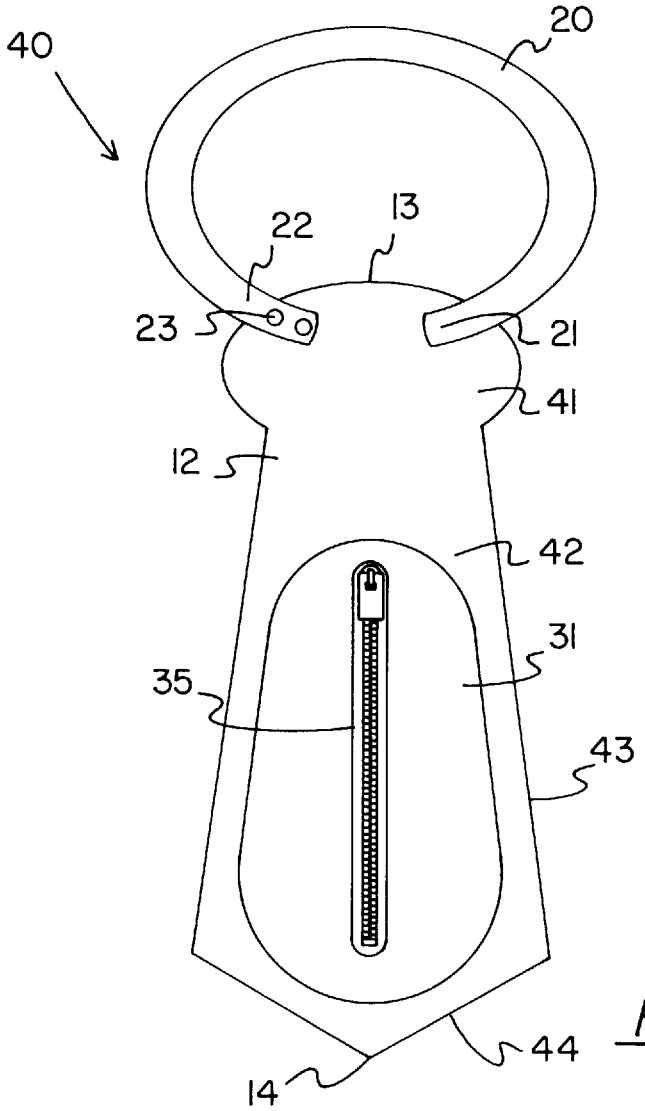
FIG. 4 is a schematic back side view of an additional embodiment of the present invention.

In an additional preferred embodiment 10, the front and back tie panels 11,12 each have top and bottom portions 41,42. The top portions 41 are positioned adjacent the tops of the front and back tie panels 11,12 and the bottom portions 42 are positioned adjacent the bottoms of the front and back tie panels 11,12. The top portions 41 of the front and back tie panels 11,12 are generally circular. The bottom portions 42 of the front and back tie panels 11,12 each have a pair of side edges 43 and a pair of bottom edges 44 that converge together at the bottoms 33 of the front and back tie panels 11,12. As illustrated in FIG. 4, the outer perimeters of the front and back pocket panels 30,31 of this embodiment 40 are preferably generally oblong and is positioned on the bottom portion 42 of the back tie panel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A necktie, comprising:

front and back tie panels each having an outer perimeter;

said outer perimeters of said front and back tie panels being coupled together;

a neck strap being generally arcuate and having first and second ends;

said first end of said neck strap being coupled to said back tie panel;

said second end of said neck strap being detachably attached to said back tie panel;

front and back pocket panels each having an outer perimeter;

said outer perimeters of said front and back pocket panels being coupled together;

said front and back pocket panels defining a pocket space therebetween for holding items therein;

said back pocket panel being coupled to said back tie panel; and said back pocket panel having an elongate slit therethrough providing an opening into said pocket space.

2. The necktie of claim 1, wherein said front and back tie panels each have a top and a bottom, said front and back tie panels each having an axis extending between said top and bottom of the respective tie panel, wherein said front and back pocket panels each have a top and bottom, said front and back pocket panels each having an axis extending between said top and bottom of the respective pocket panel, and wherein said axes of said pocket panels lie along said axis of said back tie panel.

3. The necktie of claim 2, wherein said slit has a length extending along said axis of said back pocket panel.

4. The necktie of claim 2, wherein said outer perimeters of said front and back tie panels are each generally circular and each have a diameter wherein said outer perimeter of each of said front and back tie panels have a generally straight edge portion being located at said top of the respective tie panel, said straight edge portions having a length extending substantially perpendicular to said axes of said front and back tie panels, said lengths of said straight edge portions each being less than said diameter of the respective tie panel.

5. The necktie of claim 1, wherein a zipper substantially closes said slit.

6. The necktie of claim 1, wherein said outer perimeters of said front and back tie panels are each generally circular and each have a diameter, and wherein said diameters of said outer perimeters of said front and back pocket panels are each greater than about 3 inches.

7. The necktie of claim 5, wherein said diameters of said outer perimeters of said front and back tie panels are each about 4 inches.

8. The necktie of claim 1, wherein a pair of snap fasteners detachably attach said second end of said neck strap to said top of said back tie panel.

9. The necktie of claim 1, wherein said outer perimeters of said front and back tie panels are generally circular.

10. The necktie of claim 1, wherein said front and back tie panels each have top and bottom portions, said top portions of said front and back tie panels being generally circular, said bottom portions of said front and back tie panels having a pair of side edges and a pair of bottom edges converging together at said bottoms of said front and back tie panels such that said top and bottom portions.

11. The necktie of claim 10, wherein said outer perimeters of said front and back pocket panels being generally oblong, said front and back pocket panels being positioned on said bottom portion of said back tie panel.

12. A necktie, comprising:

front and back tie panels each having an outer perimeter, a top and a bottom, said front and back tie panels being positioned adjacent one another, said tops of said front and back tie panels being positioned adjacent one another, said bottoms of said front and back tie panels being positioned adjacent one another, wherein said front and back tie panels comprises a fabric material;

said outer perimeters of said front and back tie panels being coupled together, wherein each of said outer perimeters of said front and back tie panels have inwardly extending tucked portions being stitched together to couple said outer perimeters of said front and back tie panels together;

said front and back tie panels each having an axis extending between said top and bottom of the respective tie panel;

wherein said outer perimeters of said front and back tie panels are each generally circular and each have a diameter, wherein said diameters of said outer perimeters of said front and back tie panels are each about 4 inches;

said outer perimeter of each of said front and back tie panels having a generally straight edge portion being located at said top of the respective tie panel, said straight edge portions having a length extending substantially perpendicular to said axes of said front and back tie panels, said lengths of said straight edge portions each being less than said diameter of the respective tie panel;

a neck strap being generally arcuate and having first and second ends, wherein said neck strap comprises a flexible material;

said first end of said neck strap being coupled to said top of said back tie panel, said first end of said neck strap being positioned adjacent one end of said straight edge portion of said outer perimeter of said back tie panel;

said second end of said neck strap being detachably attached to said top of said back tie panel, said second end of said neck strap being positioned adjacent another end of said straight edge portion of said outer perimeter of said back tie portion, wherein a pair of snap fasteners detachably attach said second end of said neck strap to said top of said back tie panel;

front and back pocket panels each having an outer perimeter and a top and bottom, wherein said front and back pocket panels comprise a flexible fabric material;

said front and back pocket panels being positioned adjacent one another, said tops of said front and back pocket panels being positioned adjacent one another, said bottoms of said front and back pocket panels being positioned adjacent one another, wherein said front and back pocket panels comprise a fabric material;

said outer perimeters of said front and back pocket panels being coupled together, wherein each of said outer perimeters of said front and back pocket panels have inwardly extending tucked portions being stitched together to couple said outer perimeters of said front and back pocket panels together;

said front and back pocket panels defining a pocket space therebetween for holding items therein;

said front and back pocket panels each having an axis extending between said top and bottom of the respective pocket panel;

wherein said outer perimeters of said front and back tie panels are each generally circular and each have a diameter, wherein said diameter of each of said outer perimeters of said front and back pocket panels is less than each of said diameters of said outer perimeters of said front and back tie panels;

said back pocket panel being coupled to said back tie panel, said top of said pocket panels being positioned towards said top of said back tie panel, said bottom of said pocket panels being positioned towards said bottom of said back tie panel, said axes of said pocket panels lying along said axis of said back tie panel;

said front and back pocket panels being generally centered on said back tie panel such that said outer perimeters of said pocket panels are generally equally spaced apart from said outer perimeters of said tie panels; and said back pocket panel having an elongate slit therethrough providing an opening into said pocket space, said slit having a length being extended along said axis of said back pocket panel, wherein a zipper substantially closes said slit.

* * * * *